United States Patent [19]

Beales

[11] Patent Number: 5,069,335

[45] Date of Patent: Dec. 3, 1991

[54] MODULAR ARTICLE CARRIER

[75] Inventor: Jonathan T. Beales, Philadelphia, Pa.

[73] Assignee: International Paper Company, Purchase, N.Y.

[21] Appl. No.: 555,701

[22] Filed: Jul. 23, 1990

[51] Int. Cl.[5] ..... B65D 75/00

[52] U.S. Cl. ..... 206/144; 206/180; 206/190

[58] Field of Search ..... 206/144, 175, 176, 177, 206/180, 190, 191, 170, 171, 172, 174, 427, 139; 229/120.15, 120.14, 120.18, 120.01

[56] References Cited

U.S. PATENT DOCUMENTS

| | | | |
|---|---|---|---|
| 2,543,821 | 3/1951 | Arneson | 206/180 |
| 2,665,838 | 1/1954 | Forrer | 206/180 X |
| 2,747,767 | 5/1956 | Bergstein | 206/177 |
| 2,911,126 | 11/1959 | Holton | 206/190 |
| 3,018,919 | 1/1962 | Pelt | 206/144 |
| 3,158,286 | 11/1964 | Phillips | 206/180 |
| 3,404,805 | 10/1968 | Stockmam et al. | 206/144 |
| 4,286,709 | 9/1981 | Manizza | 206/144 |

*Primary Examiner*—Jimmy G. Foster

*Assistant Examiner*—Jacob K. Ackun, Jr.

*Attorney, Agent, or Firm*—Walt Thomas Zielinski

[57] ABSTRACT

A paperboard article carrier suitable for modular construction. The complete carrier is adapted to carry four cans or bottles (a four pack) and is formed by assembling two identical two pack article carriers. The two pack article carriers are each formed of a single blank of paperboard which is folded and glued. Each two pack carrier includes a lower basket like portion and an upper, centrally positioned, handle fashioned from two layers of paperboard. One portion of each handle contains a pair of projecting friction latch tabs. The lower or basket portion of each two pack carrier is provided with a latching tongue and a latching recess, the tongue and recess of each being positioned at opposite ends of the basket. Each carrier may be separately employed as a two pack carrier. If desired, the carriers may be assembled to form a four pack carrier by placing the latching tongues into respective latching slots and by securing the friction latching tabs of the handle portions together. In a modification, the projecting friction latching tab carried by the handle is of a single thickness of the paperboard.

7 Claims, 5 Drawing Sheets

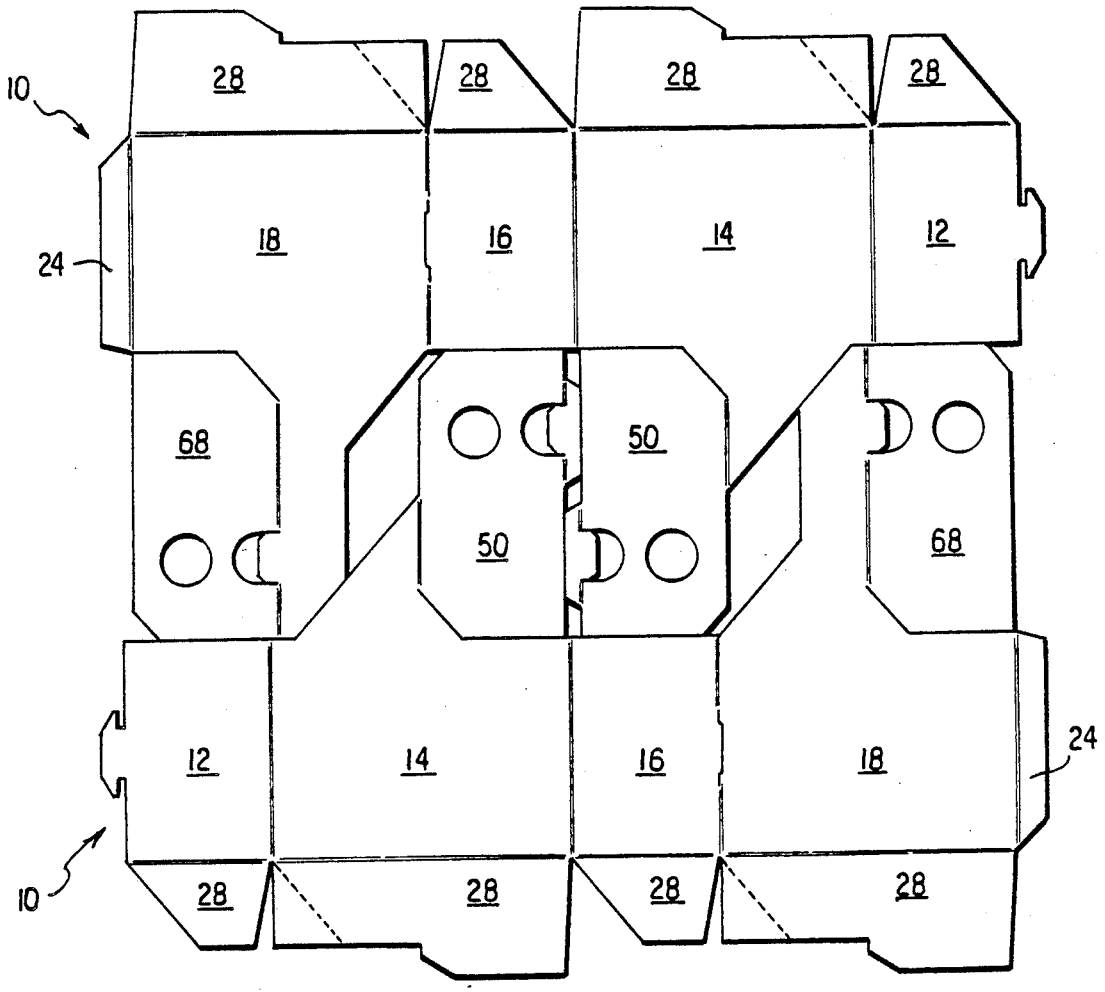
FIG. 1
FIG. 5
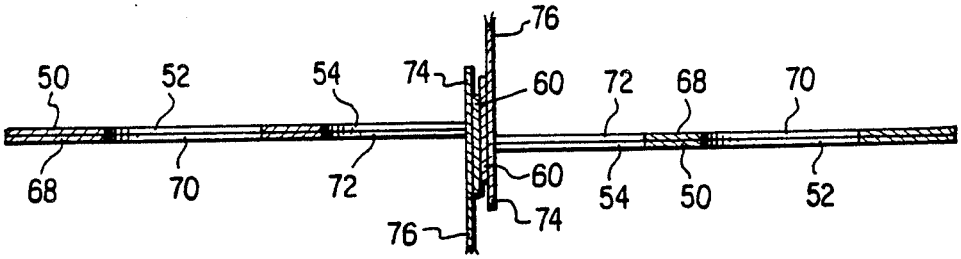
FIG. 6
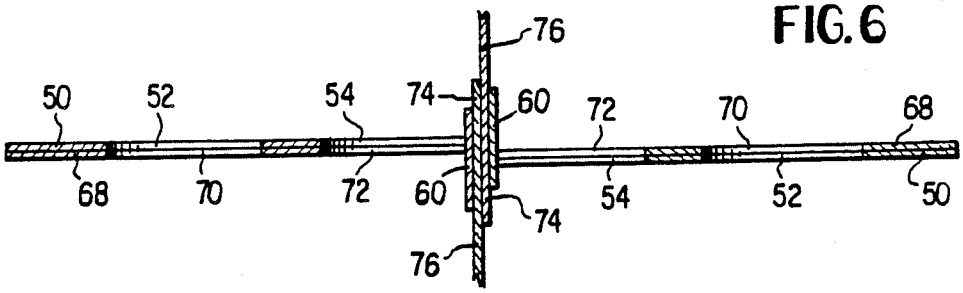

FIG. 7
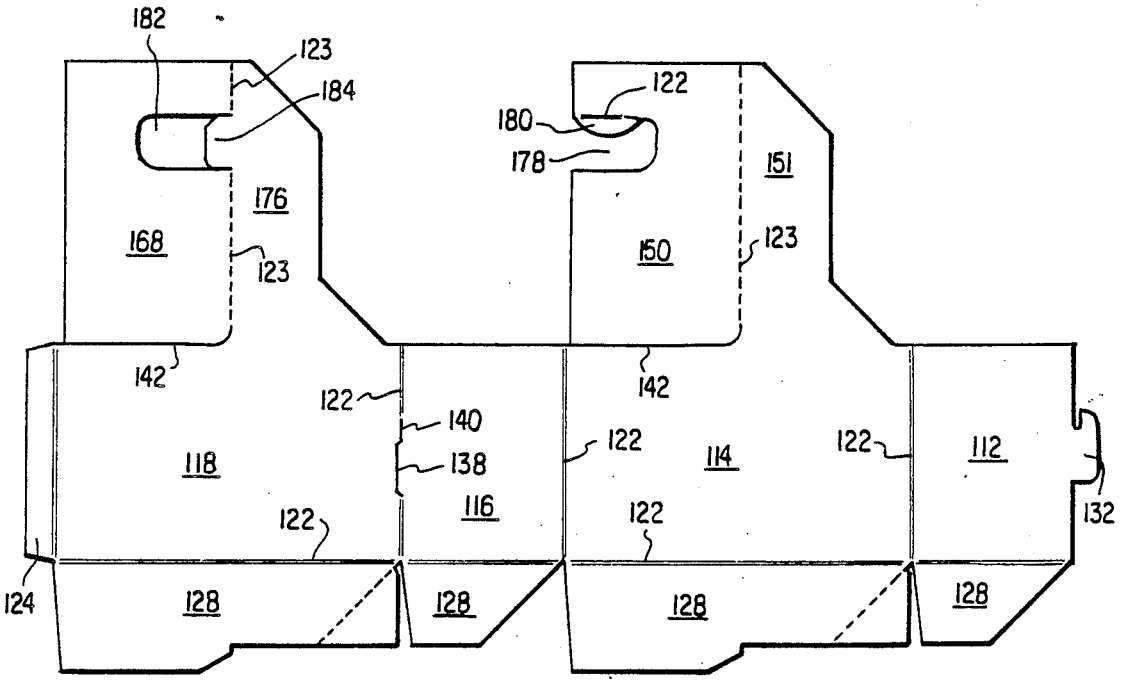
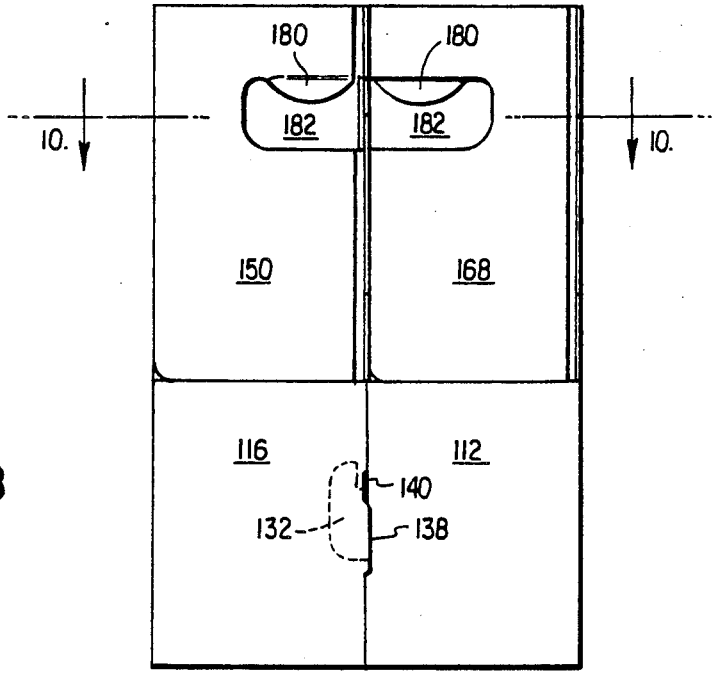
FIG. 8

MODULAR ARTICLE CARRIER

BACKGROUND OF THE INVENTION

This invention relates to article carriers and more particularly to those fashioned from paperboard. The art is already aware of two pack article carriers fashioned from paperboard or other stiff, resilient and foldable material, such constructions shown, for example, in U.S. Pat. No. 2,543,821 issued to Arneson and U.S. Pat. No. 2,821,328 issued to Ramsay. In such known constructions, a single blank of paperboard is cut, folded, and erected to form a generally rectangular basket like structure, with the bottom of the basket preferably having an automatically formed bottom so that when erected or set up from a flattened storage configuration, the carrier bottom will automatically be formed. A handle is positioned above the carrier and is integrally joined to both the sidewalls. The handle is of double thickness paperboard and may include one or more apertures for fingers. The handle also functions as a divider between two bottles or cans placed at opposite ends of the generally rectangular basket.

While serving their intended purpose, the constructions of the noted Arnesen and Ramsay patents are not particularly suited for modular use. Tandem carrier constructions wherein two identical carriers can be glued together are known, such as may be seen by reference to Manizza U.S. Pat. No. 4,286,709 and Hotton U.S. Pat. No. 2,911,126. Further, U.S. Pat. No. 3,018,919 issued to Pelt shows a composite or tandem article carrier of paperboard wherein two similar but not identical two pack carriers can be joined together. In Pelt one of the two carriers is provided with a tab and wings for coupling to the other carrier. A staple may also be employed. While capable of conversion from a two pack to a four pack carrier, the Pelt construction requires two different blanks, one for one carrier and another for the other carrier.

The prior art thus lacks a two pack carrier which can be coupled to another identical carrier to form a four pack carrier.

SUMMARY OF THE INVENTION

According to the practice of this invention, a two pack carrier is so constructed to render it capable of coupling to an identical two pack carrier to yield a four pack carrier, the two carriers then being functionally integral. This is achieved by providing a two pack carrier with a latching tongue and slot so that two of these carriers may be linked together in tandem, side by side relation. To further rigidify the structure, the handle portion of each two pack carrier is provided with frictional tab latching elements. This construction permits the use of a two pack carrier for packaging not only two bottles or cans, and which, by virtue of its construction, permits easy modular assembly into a four pack carrier without the use of auxiliary joining elements.

BRIEF DESCRIPTION OF THE DRAWINGS

FIG. 1 is a plan view of a blank showing cut and fold lines from which two of the two pack carriers of this invention may be formed.

FIG. 5 is a view taken along section 5—5 of FIG. 3 when the two carriers are assembled, showing one form of handle to handle friction engagement.

FIG. 6 is a view taken along section 5—5 of FIG. 3 when the carriers are assembled, the view showing a modified form of handle to handle frictional engagement.

FIG. 7 is a plan view of a paperboard blank for forming a modified form of the two pack carrier of this invention.

FIG. 8 is an end elevational view showing two of the assembled carriers, formed from the blank of FIG. 7, in tandem relation.

DETAILED DESCRIPTION OF THE INVENTION

Figure 2:
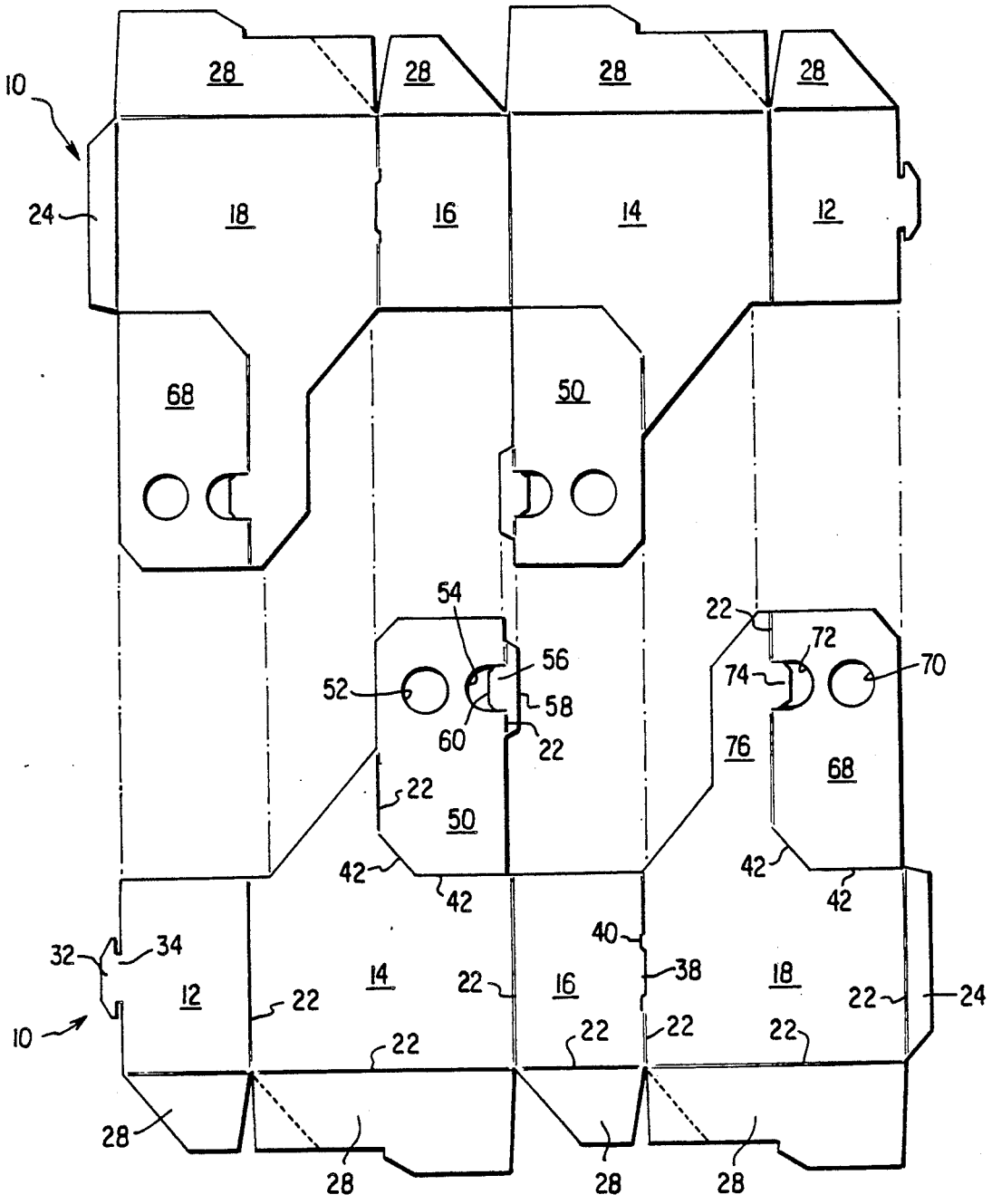
FIG. 2 is a view similar to FIG. 1, showing the upper and lower portions of the blank of FIG. 1 separated.

Referring now to FIGS. 1 and 2 of the drawings, and particularly FIG. 1, the numeral 10 denotes a paperboard blank, generally rectangular, which is cut and scored along the indicated lines to form two identical individual two pack article carrier blanks, the later being shown in FIG. 2 after the lower carrier blank has been separated from the upper carrier blank. It will be observed that nearly all of the material of blank 10 is used, thereby permitting economies in manufacture due to a minimum of waste or unused paperboard.

Referring now to the lower blank 11 of FIG. 2, the blank includes serially arranged panels 12, 14, 16, and 18, the panels separated and defined by fold lines 22. A manufacturer's flap 24 is provided on one end of panel !8. Panels 12 and 16 are adapted to form end walls of a two pack carrier, while panels 14 and 18 are adapted to form sidewalls of the carrier.

Bottom forming panels 28 are integrally connected to panels 12, 14, 16, and 18 by fold lines 22. The exact shape of bottom forming panels 28 forms no part of this invention, these panels acting, as is well known, to automatically form a bottom when the carton is erected from its flattened, tube like storage configuration. The free edge of panel 12 is provided with a latching tongue 32, generally T shaped, joined to panel 12 by leg portion 34. A cut line 38 and two aligned cut lines 40 at the ends of 38, laterally displaced, centrally interrupt the vertically extending fold line 22 joining panels 16 and 18. When folded 90 degrees, panels 16 and 18, together with cut 38 and laterally displaced cuts 40, form a latching tongue recess for the reception of latching tongue 32, as will later be apparent.

Cut lines 42 are provided on the upper portions of panels 14 and 18, with the cut lines 42 and a fold line 22 on panel 14 defining a first handle panel 50. Similarly, cut lines 42 and fold lines 22 on the upper portion of panel 18 define a second handle panel 68. Panel 50 includes a finger opening 52 and, a generally semi-circular opening 54. Fold lines 22, at the right edge of panel 60, define with opening 54 a short friction latching tab 58 having an edge 60. Similarly, handle panel 68 is provided with finger opening 70, a generally half circular die cut opening 72 which defines, with fold lines 22, a longer friction latching tab 74. The left upper portion of panel 18 is denoted as 76 and borders handle panel 68.

Both the lower and upper two pack carrier blanks of FIG. 2 are identical and accordingly a detailed description of only the lower one is given.

Figure 3:
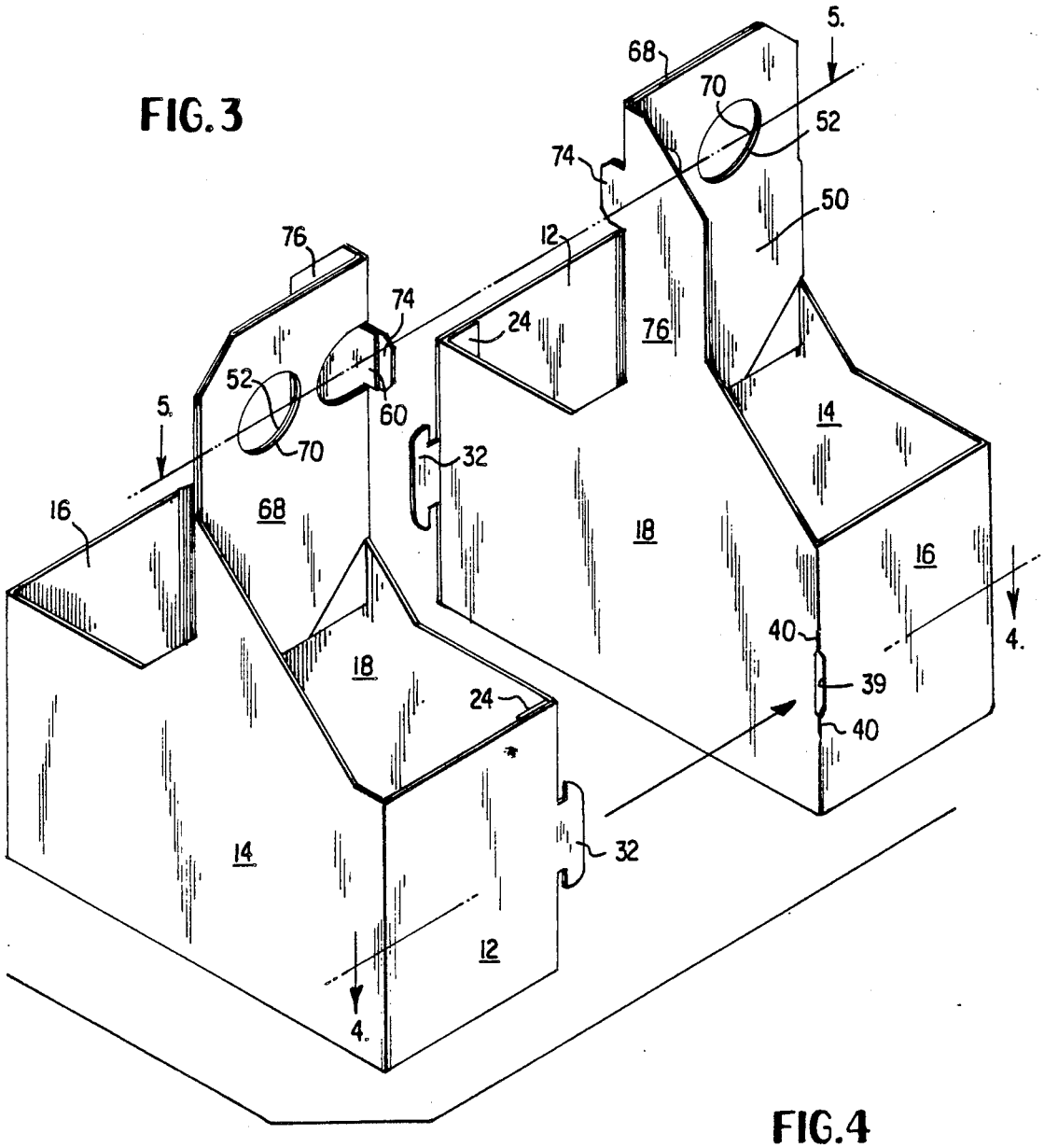
FIG. 3 is a perspective view illustrating two of the two pack carriers of this invention prior to their modular or tandem assembly to form a four pack carrier.
Figure 4:
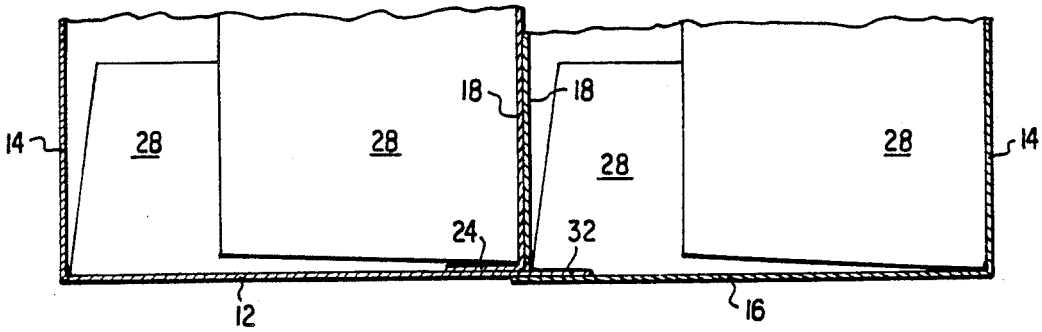
FIG. 4 is a view taken along section 4—4 of FIG. 3 when the two carriers are assembled.

Referring now to FIG. 3, each of the two pack carrier blanks of FIG. 2 has been folded and erected by gluing manufacturer's flap 24 to a corresponding portion of panel 12. Handle portions 50 and 68 may be glued together to form a two layer laminate handle, with upper handle portion 76 being at right angles to this two layer laminate. Shorter friction tab 60 is preferably in surface, but not glued, contact with longer friction tab 74. As indicated by the arrow in FIG. 3, the two two pack carriers are assembled by moving them together, so that each latching tongue 32 engages in a corresponding latching aperture or opening 39 formed by cuts 38 and 40. The basket like portions of the two carriers are thus secured together. The action of a latching tongue 32 received in a latching opening 39 is shown at FIG. 4.

Additionally, handle portions 76 are in surface to surface contact, with either one of two friction latching configurations of friction tabs 60 and 74, these two different configurations shown at FIGS. 5 and 6 respectively.

Referring now to FIG. 5, the two friction locking tabs 60 and 74 of the right hand carrier are placed to the left of the friction latching tabs 60 and 74 of the left hand carrier. The resulting four layer laminate is in the order 74-60-60-74.

In FIG. 6, longer friction tabs 74 are pushed laterally together in opposite directions to open a space between the each pair of tabs 60 and 74. Each tab 74 of one carrier is frictionally engaged between tabs 74 and 60 of the opposite or other carrier. The completed friction latch for the handles is defined by a four layer laminate in the order 60-74-74-60.

Either of these two arrangements inhibits relative lateral movement of the handle portions of the two carriers in two mutually orthogonal directions.

From the consideration of FIG. 3, it will be apparent that each identical two pack carrier may be used as a two pack carrier, or alternatively, may be used to form an essentially integral four pack carrier. Manual assembly, at a fast food outlet for example of these two two pack carriers is relatively easy and rapid, no auxiliary coupling means such as glue or staples being required.

A second embodiment of the carrier of this invention will now be described and is shown at FIGS. 7-10. Because of similarity of some elements of the two embodiments, corresponding panel numerals bear the prefix 1. Thus panel 12 of the first embodiment is designated as 112 in the second embodiment.

Referring now to FIG. 7, the numerals 112, 114, 116 and 118 denote a series of generally rectangular panels joined by fold or score lines 122. Flap 124 is the usual manufacturer's flap. Automatic bottom forming panels are denoted as 128 and themselves form no part of the invention, being known in this art. A locking tongue 132 is carried by panel 112 and projects from a free edge of that panel. Cut line 142 and perforated fold line 123 form panels 150 and 151, the latter being integral with panel 114. Panel 150 is provided with a generally sidewise U-shaped recess 178, with the upper part of the recess being interrupted by tab 180, the latter being integral with panel 150. Tab 180 is foldable about score line 122 to protect the user's finger.

Another cut line 142 and another perforated fold line 123 defines handle panels 168 and 176. Panel 168 includes a generally rectangular recess 182, while panel 176 carries an integral tongue 184 whose base is substantially colinear with the axis of aligned perforated fold lines 123 at the left of FIG. 7.

Cut lines 138 and 140, corresponding to cut lines 38 and 40 of the embodiment, are included between panels 116 and 118, with cut line 140 being substantially colinear with contiguous score lines 122, with cut line 138 being slightly laterally displaced therefrom. As will presently be described, upon folding panels 116 and 118 ninety degrees with respect to each other, cut line 138 defines a recess 139 at the fold.

Figure 9:
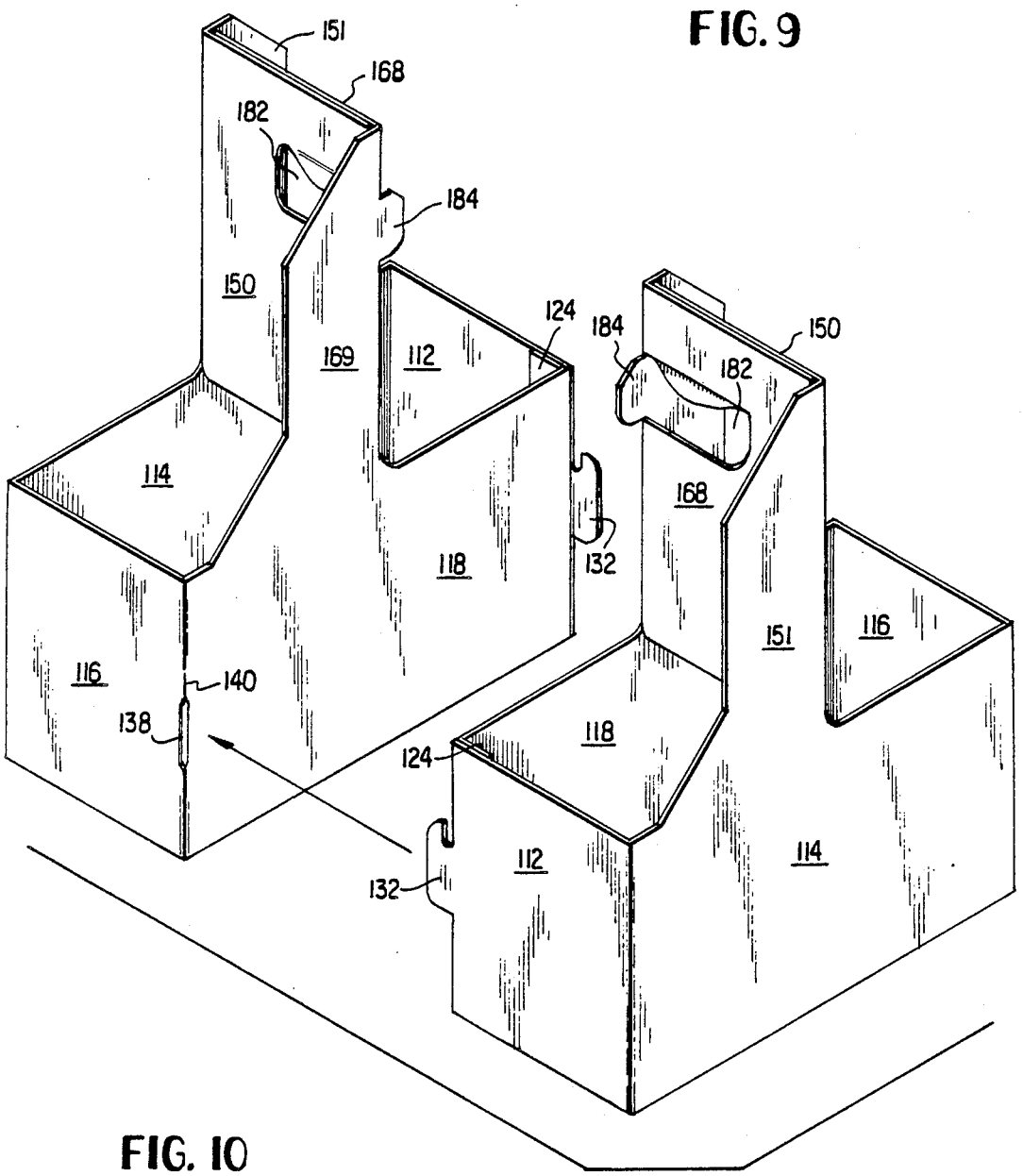
FIG. 9 is a perspective view, similar to FIG. 3, showing two of the modified carriers just prior to their modular or tandem assembly to form a four pack carrier.
Figure 10:
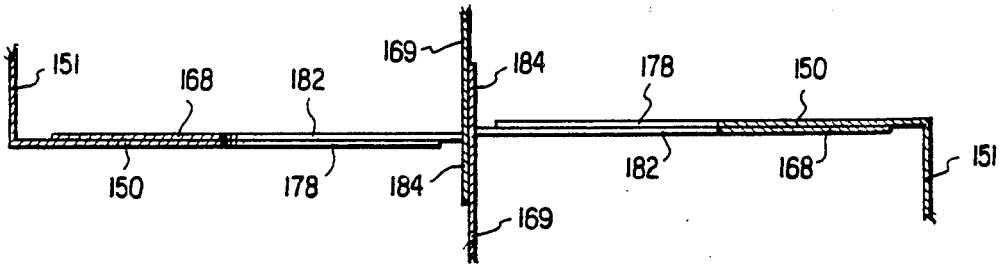
FIG. 10 is a view taken along section 10—10 of FIG. 8.

Referring now to FIG. 8, two of the blanks shown at FIG. 7 have been erected or squared up to assemble them, and have been placed together in modular or tandem relationship. Also, as shown at FIG. 9, it is seen that tongues 132 enter openings 139 and slit 140 upon moving the two carriers together, as indicated by the arrow at FIG. 9. Locking tonguess 132 serve to releasably lock the main portions of the basket like carriers of this invention together, while tabs 184 are in surface to surface, frictional engagement with each other, as shown at FIG. 10. FIG. 10 illustrates that the right hand tab 184 of FIG. 9, in the assembled configuration of FIG. 8, frictionally lies on the left of the left hand tab 184 of FIG. 9. The resiliency of the paperboard tends to maintain the tabs 184 together.

Thus, in the assembled configuration of FIG. 8, the two carriers are held at their main, lower portions and at the upper handle portions to form a fairly rigid structure. As before, paperboard or other stiff, resilient and bendable sheet material is the preferred material of construction. The blanks preferably are die cut.

The second embodiment thus functions in substantially the same manner as the first.

I claim:

1. A modular two pack carrier, the carrier formed of a unitary blank of paperboard and having a generally rectangular basket portion having opposing side and end panels, a handle panel positioned above the basket portion, the handle panel having two overlapping panels each formed from a respective side wall of the carrier, the plane of said handle panel being transverse to the carrier side panels and parallel to the carrier end panels, one end of the basket portion of the carrier having a latching tongue, the other end of the basket portion of the carrier having a complementary latching recess, said latching tongue projecting beyond one side panel, whereby two of said two pack carriers can be latched together in side by side, tandem relation to form a four pack carrier.

2. The two pack carrier of claim 1 wherein said handle portion carries a pair of parallel friction latching tabs, said tabs being in surface contact with such other, said tabs located contiguous to said one side panel.

3. The two pack carrier of claim 2 wherein said friction tabs are of unequal length.

4. The two pack carrier of claim 2 wherein one friction latching tab is integral with one side wall and the other friction locking tab is integral with the other side wall.

5. The two pack carrier of claim 1 wherein said handle panel is positioned over the basket portion carries a planar friction latching tab of a single thickness of the blank.

6. The two pack carrier of claim 5 including a generally rectangular opening in said handle panel, the opening lying in the handle panel plane, one peripheral part of the opening defined by said friction latching tab, the plane of the opening being orthogonal to the plane of the friction latching tab.

7. The two pack carrier of claim 6 including a foldable tab at an upper peripheral portion of said handle opening to protect the user's finger.

* * * * *